US006311834B1

(12) United States Patent
Focke et al.

(10) Patent No.: US 6,311,834 B1
(45) Date of Patent: Nov. 6, 2001

(54) HINGE-LID BOX FOR CIGARETTES

(75) Inventors: Heinz Focke, Verden (DE); Dieter Neuber, Upper Saddle River, NY (US)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/508,960

(22) PCT Filed: Aug. 29, 1998

(86) PCT No.: PCT/EP98/05509

§ 371 Date: Mar. 20, 2000

§ 102(e) Date: Mar. 20, 2000

(87) PCT Pub. No.: WO99/15436

PCT Pub. Date: Apr. 1, 1999

(30) Foreign Application Priority Data

Sep. 19, 1997 (DE) ..... 197 41 481

(51) Int. Cl.[7] ..... B65D 85/10; B65D 43/16

(52) U.S. Cl. ..... 206/268; 206/273; 229/160.1

(58) Field of Search ..... 206/264, 268, 206/271, 273; 229/160.1

(56) References Cited

U.S. PATENT DOCUMENTS 4,753,383 * 6/1988 Focke et al. ..... 229/160.1
4,753,384 * 6/1988 Focke et al. ..... 229/160.1
4,923,059 5/1990 Evers et al. .
5,129,513 7/1992 David et al. .
5,143,282 * 9/1992 Pham ..... 229/160.1
5,487,468 1/1996 Sheahan .
5,806,671 * 9/1998 Focke et al. ..... 206/268
5,823,331 * 10/1998 Manservigi et al. ..... 206/268

FOREIGN PATENT DOCUMENTS 36 15 828 11/1987 (DE) .
36 24 345 1/1988 (DE) .
195 19 505 12/1996 (DE) .
196 14 043 10/1997 (DE) .
205766 3/1986 (EP) .
745541 5/1996 (EP) .
764594 3/1997 (EP) .

* cited by examiner

*Primary Examiner*—Bryon P. Gehman
(74) *Attorney, Agent, or Firm*—Sughrue, Mion, Zinn, Macpeak & Seas, PLLC

(57) ABSTRACT

A hinge-lid box for cigarettes has a box part (10) and a lid (11). Hinge-lid boxes have, because of their design or structure, four vertical edges. These edges have a particular design, ie., two vertical edges are designed as rounded edges (24, 25), and the two other edges as angular edges (26, 27) with a rectangular cross-section. The rounded edges (24, 25) can be located in the area of one and the same side wall (14/19) or be in diagonally opposite positions.

10 Claims, 7 Drawing Sheets

Fig. 8
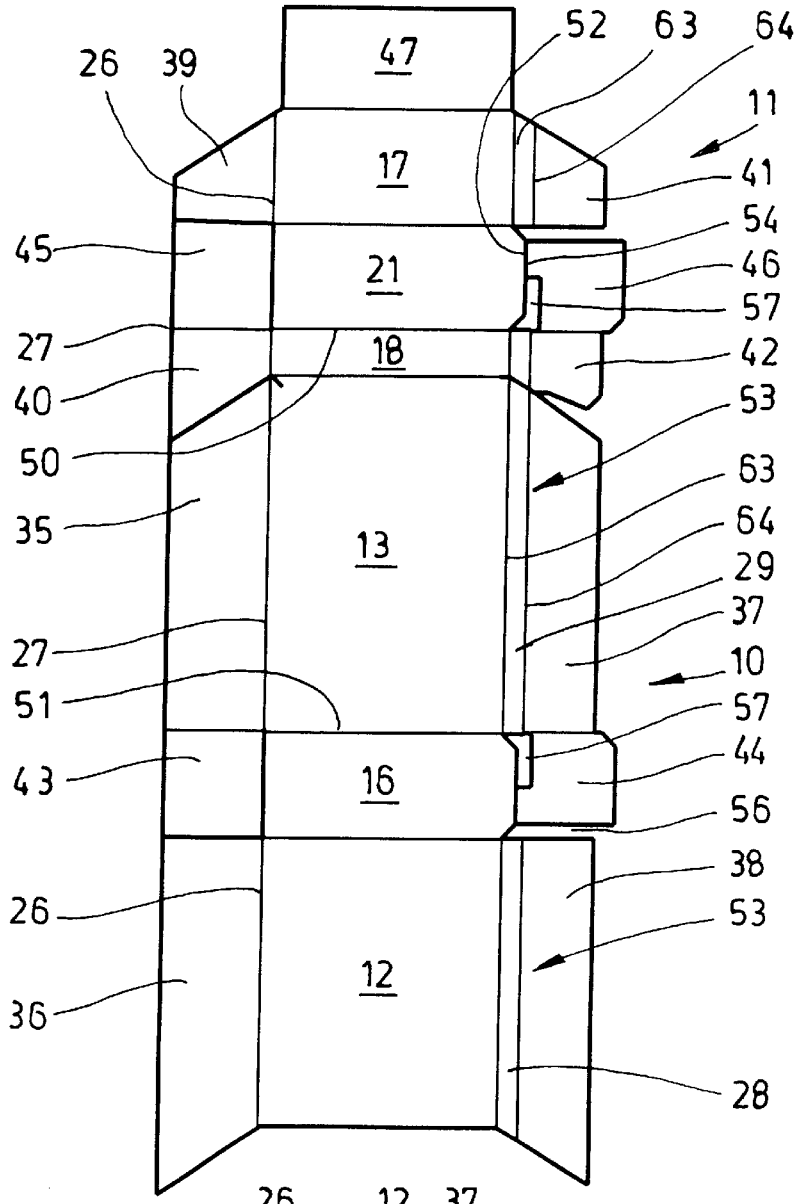
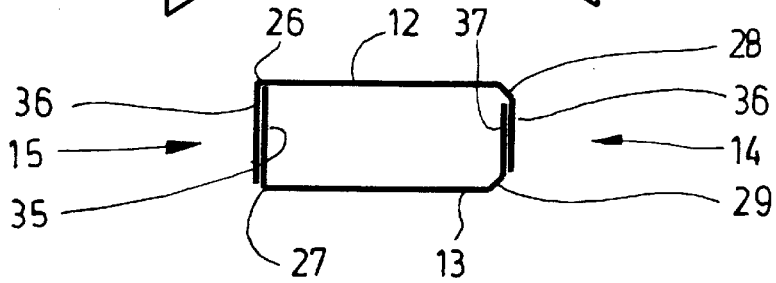
Fig. 9

Fig. 12
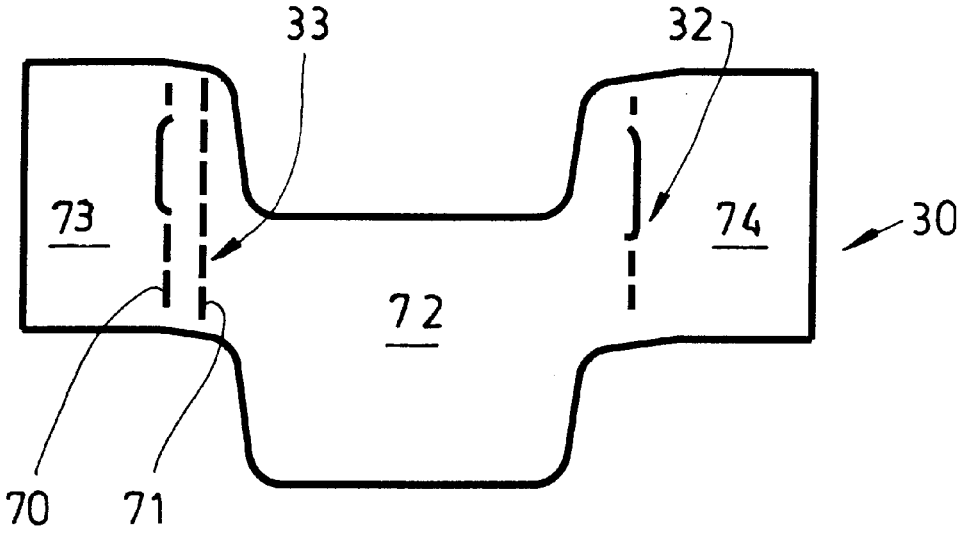
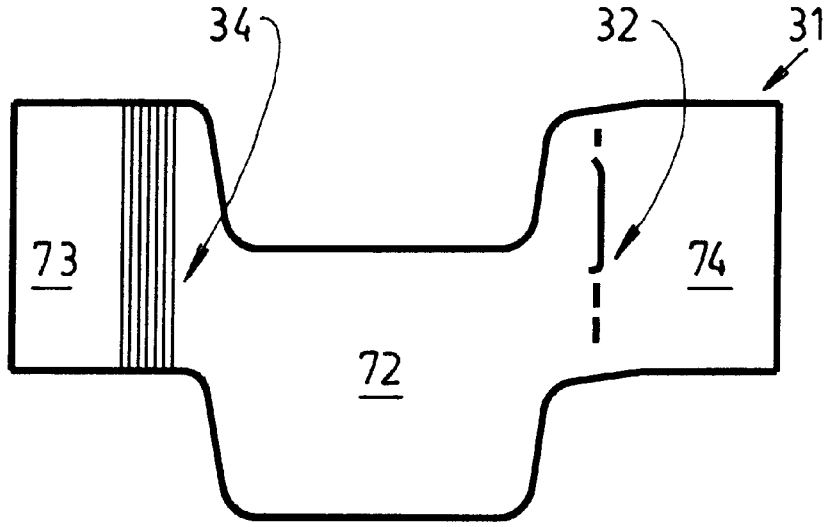
Fig. 13

HINGE-LID BOX FOR CIGARETTES

BACKGROUND OF THE INVENTION

The invention relates to hinge-lid boxes (hinge-lid packs) for cigarettes or the like, comprising a box part, lid and collar, it being the case that a box rear wall is connected to a lid rear wall via a transversely directed articulation line, and the hinge-lid box is of an overall (more or less) cuboidal configuration with four upright pack edges as the lateral boundary of the box front wall and lid front wall, on the one hand, and the box rear wall and lid rear wall, on the other hand. The invention also relates to blanks for producing such hinge-lid boxes.

Hinge-lid boxes are among the commonest types of packs for cigarettes. In the case of this type of pack the (four) upright pack edges are intrinsically of cross-sectionally right-angled design. However, cigarette packs which are of this type and in which the upright pack edges, including corresponding collar edges, are of cross-sectionally rounded design, with a quarter-circle in cross section, or bevelled, with a corresponding bevelled formation, are already known (EP 204 933 and EP 205 766).

SUMMARY OF THE INVENTION

The object of the invention is to develop and improve the configuration of hinge-lid boxes for cigarettes or other products, in particular to the effect that the surface areas available for printing, namely decorative or informative printed sections, are utilized in more optimum fashion.

In order to achieve this object, the hinge-lid box according to the invention is characterized in that two of the four pack edges are of cross-sectionally right-angled design and the other two pack edges are of cross-sectionally rounded design—forming a quarter-circle circle in the process—or bevelled design—forming a bevel formation in the process—the rounded or bevelled pack edges being adapted, in terms of the quarter-circle or bevel dimensioning, to the dimensions of a cigarette.

In hinge-lid boxes with (exclusively) rounded or bevelled pack edges, the interior of the packs is utilized more favourably, that is to say in accordance with the predetermined contour of the pack contents (cigarettes). The hinge-lid boxes designed according to the invention likewise have this advantage, but can provide larger free visible surfaces in the region of the front side and rear side, and in the region of the side surfaces, of the hinge-lid box. This is important or decorative or contents-related printing. The configuration of the hinge-lid box according to the invention is particularly advantageous if a printed section is to extend over an (upright) pack edge into the region of a (narrow) side wall. In this case, the printing may continue beyond the (one) rounded or bevelled pack edge.

The collar, which is preferably formed from a separate blank, is adapted to the configuration of the hinge-lid box, namely with one cross-sectionally right-angled collar edge and one rounded or bevelled collar edge.

A further special feature is the configuration of blanks for producing hinge-lid boxes according to the invention. Folding lines or scores (for rounded pack edges) are provided in selected regions by impressing operations. Folding tabs of the blank, in particular side tabs and corner tabs, are configured in a specific way in terms of their dimensions.

BRIEF DESCRIPTION OF THE DRAWINGS

Further details of the hinge-lid boxes according to the invention and of the blanks for producing the same are explained in more detail hereinbelow with reference to exemplary embodiments illustrated in the drawings, in which:

FIG. 8 shows a blank for a hinge-lid box according to FIG. 3, FIG. 9 shows a vastly simplified cross section of a hinge-lid box from a blank according to FIG. 8, FIG. 12 shows a collar for a hinge-lid box according to FIG. 3 or FIG. 4, and FIG. 13 shows a collar for a hinge-lid box according to FIG. 1 or FIG. 2.

Figure 2:
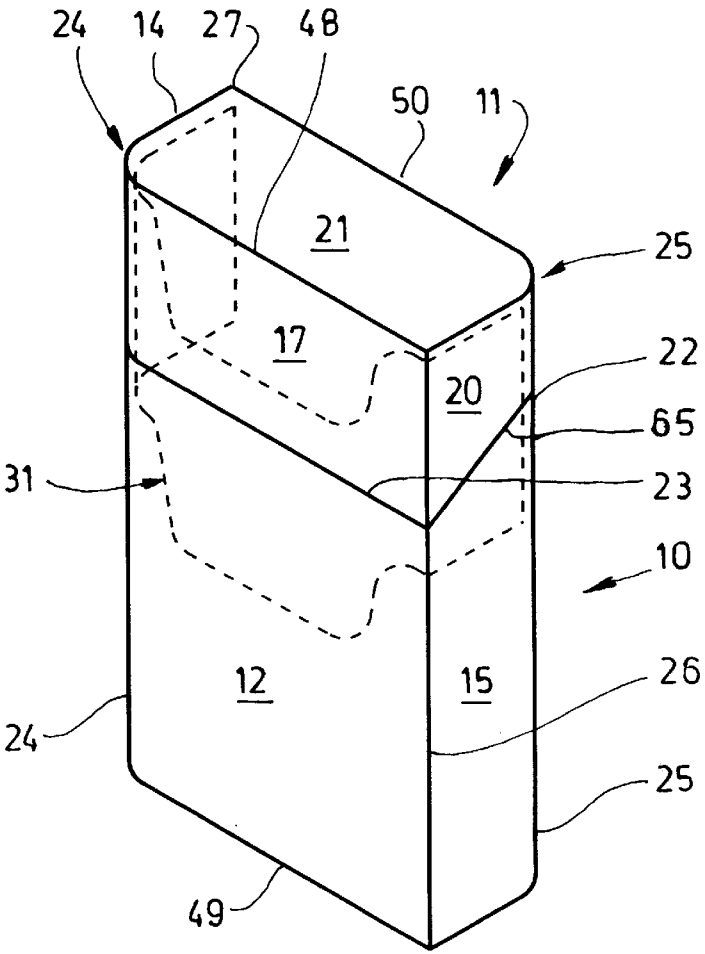
FIG. 2 shows, likewise in perspective, an exemplary embodiment with diagonally opposite rounded pack edges.

The exemplary embodiments in the drawings relate to hinge-lid boxes (hinge-lid packs) of a classic basic construction, namely with a (bottom) box part 10 and a lid 11. The box part 10 comprises a (large-surface-area) box front wall 12, an opposite box rear wall 13 and narrow box side walls 14 and 15. The box part 10 is closed off at the bottom by a base wall 16.

Analogously to this, the lid 11 comprises a lid front wall 17, lid rear wall 18 and lid side walls 19, 20—each in extension of the corresponding walls of the box part. At the top, the lid 11 is closed off by an end wall 21, located opposite the base wall 16.

The box part 10 and lid 11 are connected to one another in a pivotable manner in the region of the box rear wall 13 and lid rear wall 18, to be precise by a transversely directed articulation line 22. In the closed position, the box part 10 and lid 11 butt against one another in the region of the front side along a transversely directed closing line 23. This is continued, in the region of the box side walls 14, 15 and lid side walls 19, 20, as an oblique line 65, which slopes up obliquely from the front to the rear side.

DETAILED DESCRIPTION OF THE INVENTION

The hinge-lid box, which is of an overall essentially cuboidal configuration, is bounded by four upright pack edges. In the present hinge-lid boxes, these are designed in a specific way.

Figure 1:
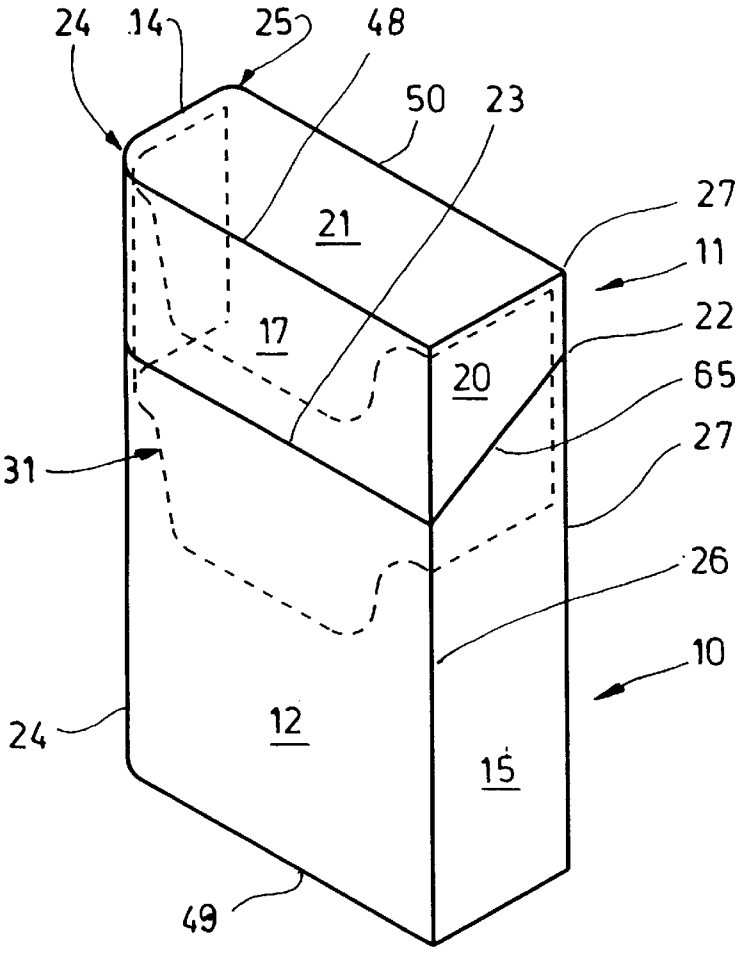
FIG. 1 shows a perspective illustration of a hinge lid box with two adjacent rounded pack edges.

In the exemplary embodiments according to FIGS. 1 and 2, in each case two upright pack edges in the region of the box part 10 and lid 11 are designed as round edges 24, 25. The other two pack edges are configured as angular edges 26, 27, namely with a right-angled cross section.

In the exemplary embodiment of FIG. 1, two adjacent pack edges are round edges 24, 25, which bound a box side wall 14 and the adjoining lid side wall 19. These two adjacent round edges 24, 25 are cross-sectionally in the form of a quarter-circle, to be precise approximately in accordance with the diameter of a cigarette. The opposite angular edges 26, 27, which bound the opposite box side wall 15 and lid side wall 20, are of cross-sectionally rectangular design, as in the case of a conventional hinge-lid box.

In the hinge-lid box according to FIG. 2, the two round edges 24, 25, on the one hand, and the two angular edges 26, 27, on the other hand, are arranged as diagonally opposite pack edges. Accordingly, each side wall 14/19 and 15/20 is bounded, on the one hand, by a round edge 24 or 25 and, on the other hand, by an angular edge 26 or 27.

Figure 4:
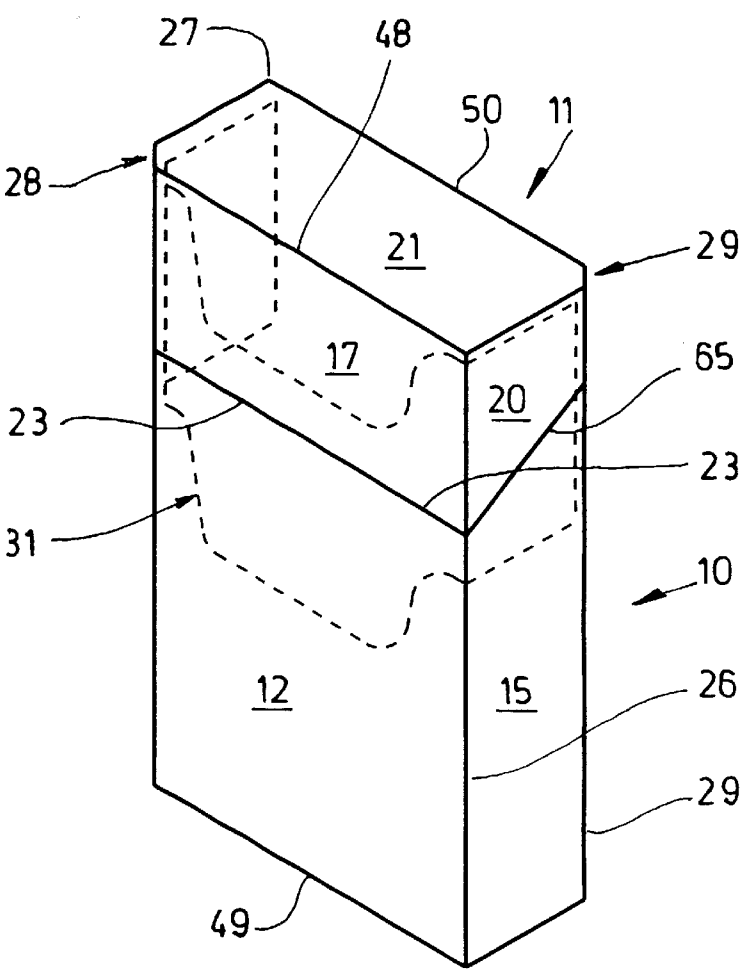
FIG. 4 shows a hinge-lid box with bevelled pack edges analogous to FIG. 2.
Figure 3:
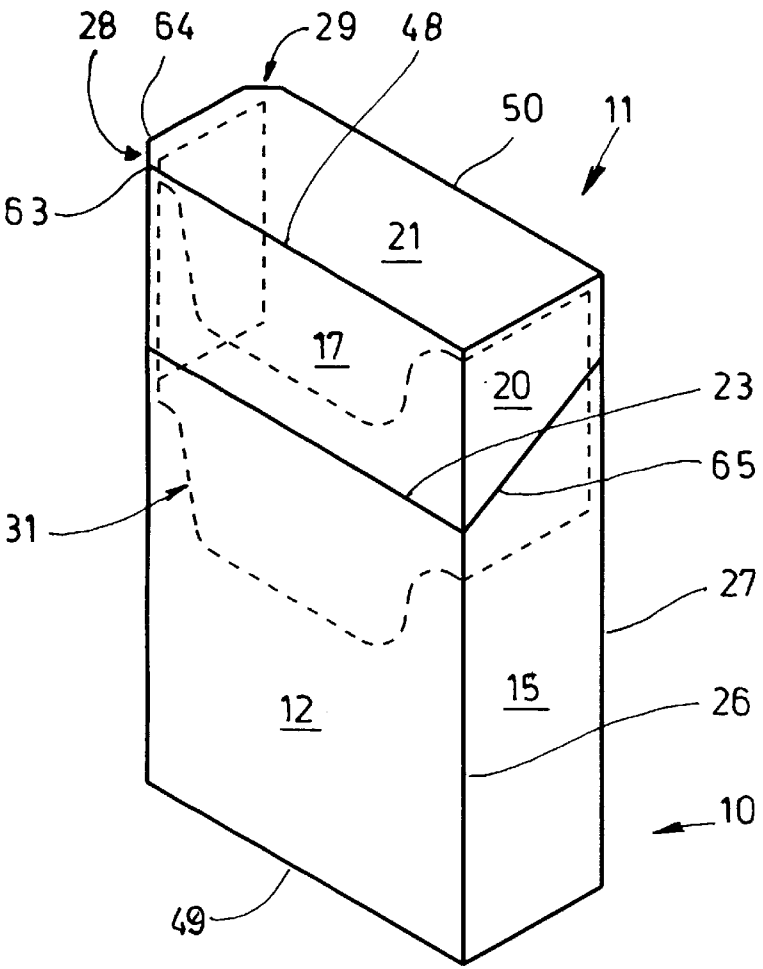
FIG. 3 shows a hinge-lid box with bevelled pack edges in an arrangement analogous to FIG. 1.

The hinge-lid boxes according to FIG. 3 and FIG. 4 are configured in a manner analogous to the exemplary embodiments described above, but with bevelled edges 28, 29 instead of round edges. Accordingly, in the exemplary embodiment of FIG. 3, two adjacent pack edges bounding a side wall 14/19 are designed as bevelled edges 28, 29 and the two respectively opposite pack edges are designed as angular edges 26, 27. In the exemplary embodiment of FIG. 4, the two bevelled edges 28, 29 are diagonally opposite pack edges. Accordingly, the two angular edges 26, 27 are likewise positioned diagonally opposite one another.

The hinge-lid boxes illustrated in the drawings are each provided with a collar 30, 31 made of a separate blank (FIG. 12 and FIG. 13). In terms of upright collar edges 32, 33, 34, the collars 30, 31 are designed in a manner analogous to the cross-sectional configuration of the hinge-lid box.

Blanks—usually consisting of thin cardboard—for the abovedescribed hinge-lid boxes, on the one hand, and the collar 30, 31, on the other hand, are designed in a specific way.

Figure 5:
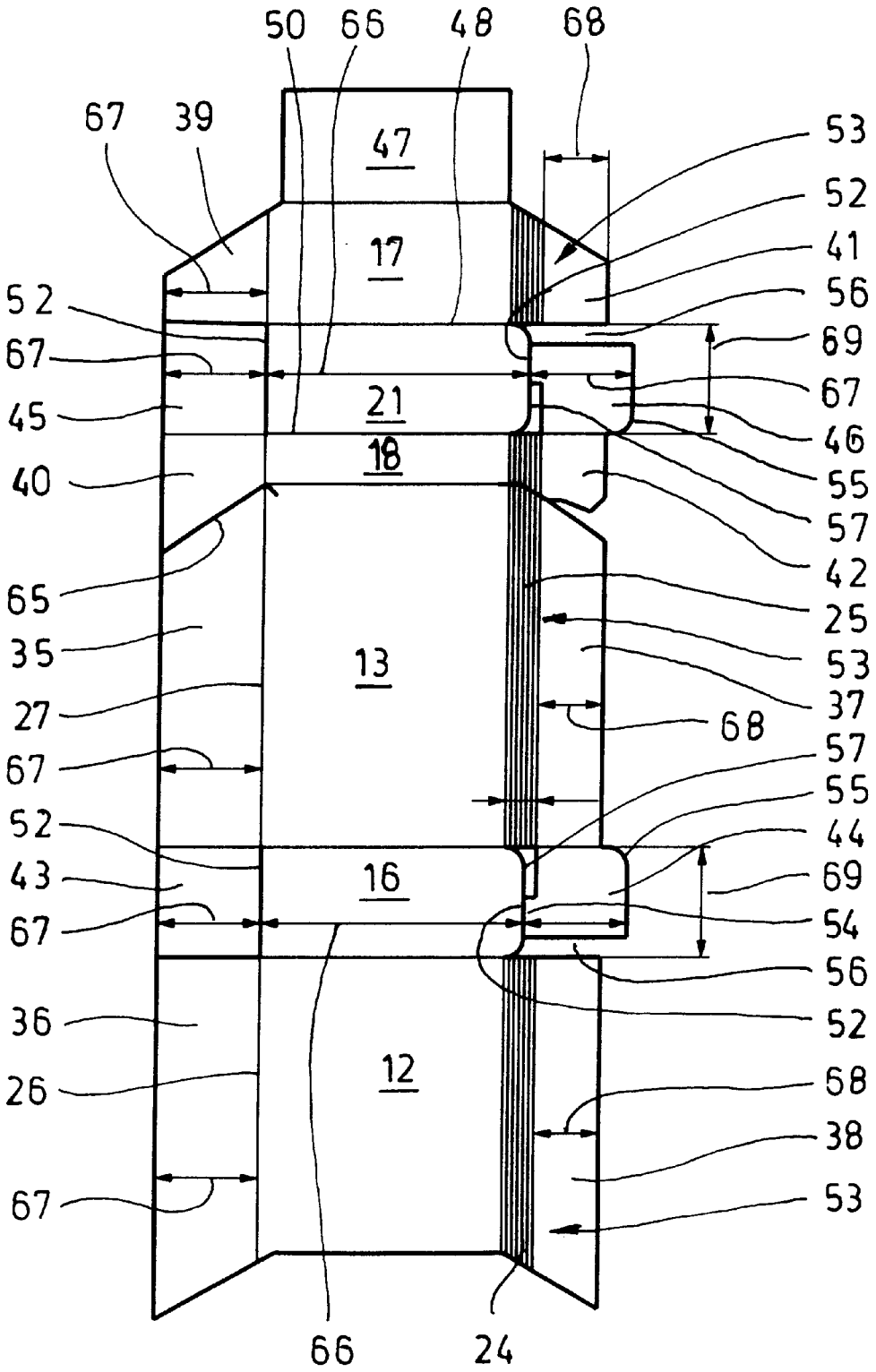
FIG. 5 shows a spread-out blank for a hinge-lid box according to FIG. 1.

FIG. 5 shows a blank for a hinge-lid box according to FIG. 1. The basic construction of the blank is of conventional design, the box side walls 14, 15 each comprising (partially) overlapping side tabs 35, 36 and 37, 38. Correspondingly, the lid side walls 19, 20 are formed from lid side tabs 39, 40 and 41, 42 with (partial) overlapping. Also important are, in principle, conventional corner tabs, to be precise base corner tabs 43, 44 and lid corner tabs 45, 46. The abovementioned corner tabs 43..46 are each connected to adjacent side tabs, namely inner side tabs 35 and 37 of the box part and inner lid side tabs 39 and 41, respectively. In a folded hinge-lid box, the corner tabs 43..46 each butt against the inside of the base wall 16 and of the end wall 21. The blank of a hinge-lid box also contains a lid inner tab 47, which, when the hinge-lid box is finished, butts against the inside of the lid front wall 17.

The abovedescribed parts and/or regions of the blank or a hinge-lid box are separated off from one another by longitudinally and transversely directed folding lines and punched cuts. The transversely directed front edge 48 between the end wall 21, on the one hand, and lid front wall 17, on the other hand, and the transversely directed front edge 49 between the base wall 16, on the one hand, and box front wall 12, on the other hand, are of particular interest. Corresponding, parallel rear edges 50, 51 separate the end wall 21 off from the lid rear wall 18 and the base wall 16 off from the box rear wall 13.

In the longitudinal direction of the elongate blank, the specifically designed pack edges run as corresponding folding lines. In order to form the cross-sectionally rectangular angular edges 26 and 27, the blank is formed with a continuous folding line, interrupted by punched lines 52 in the region of the corner tabs 43 and 45.

A continuous impressed strip 53 is arranged on the opposite side of the blank, in order to form the round edges 24, 25. This strip comprises a plurality of parallel scores, that is to say impressed grooves located closely one beside the other. These cause and/or facilitate the formation of the round edges 24, 25 during folding of the blank. The impressed strip 53 does not extend in the region of the base wall 16 and of the end wall 21.

A further special feature s the configuration of the side tabs 37, 38 and 40, 42 in the region of the round edges 24, 25. The side tabs 37, 38 in the region of the box part 10 and the lid side tabs 40, 41 are designed with a smaller width than he respectively opposite and corresponding side tabs 35, 36 and lid side tabs 38, 39. When the hinge-lid box is finished, this results in overlapping and connection of the (narrower) side tabs 37, 38 for forming the box side wall 14 on the one hand, and of the lid side tabs 40, 41 for forming the lid side wall 19G on the other hand, merely in a region between the round edges 24, 25. The hinge-lid box is of single-layered design in the region of the round edges 24, 25. On the opposite side, that is to say in the region of the angular edges 26, 27, the blank is designed in the manner of a conventional blank for a hinge-lid box.

There is a deviation from this design principle of the base corner tab 44 and lid corner tab 46 in the region of the round edges 24, 25. These corner tabs 44, 46 are designed with the full width of the hinge-lid box (inner dimensions) in the transverse direction of the blank, that is to say in the same way as the corner tabs 43, 45. In the folded position, a supporting edge 54 of the corner tab 44, 46 is thus supported on a pack wall, to be precise the base corner tab 44 has the supporting edge 54 butting against the rear edge 51 (on the rear side) of the hinge-lid box, while the supporting edge 54 of the lid corner tab 46 is supported on the rear edge 50 in the region of the lid 11.

The corner tabs 44 and 46 are each designed with a round corner 55 in the region of a free, outer corner. Said round corner butts against the round edge 24 when the hinge-lid box is finished.

A punched cutout 56 is formed between the base corner tab 44, on the one hand, and the (outer) side tab 38 of the box part. Said cutout is also provided analogously in the region of the lid corner tab 46, opposite the outer lid side tab 40.

A further punched-out section, namely a clearance 57, is arranged in a sub-region of the punched line 52 of the base corner tab 44, on the one hand, and of the lid corner tab 46, on the other hand. The clearance 57 extends over part of the extent of the corner tabs 44, 46 such that the round corner formed in this region by the base wall 16 or the end wall 21, respectively, is exposed. In this region, the relevant corner tabs 44, 46 avoid the otherwise inevitable formation of a gusset which tapers to a point, on account of the configuration of the base wall 16 and of the end wall 21.

In an advantageous exemplary embodiment of a blank according to FIG. 5, the important dimensions of blank regions and folding tabs are as follows: the pack width 66, which is illustrated in the region of the base wall 16 and end wall 21, is approximately 55 mm. The lateral folding tabs arranged on the side of the corner edges 26, 27 determine the pack depth 67 at, in the present case, 21.5 mm. The side tabs 35, 36 and the lid side tabs 39, 40, including the corner tabs 43, 45, are dimensioned with this width throughout, that is to say with the dimension of the pack depth 67.

In the region of the round edges 24, 25, the impressed strips 53 are designed with the width of 6.55 mm throughout. The free width 68 of the side tabs 37, 38 and of the lid side tabs 41, 42 is considerably reduced, and is 13.5 mm. In this region, the associated side tabs 37, 38; 41, 42 butt against one another. The corner tabs in the region of the round edges 24, 25, that is to say the base corner tab 44 and lid corner tab 46, are dimensioned an accordance with the pack depth 67, that is to say in this case at 21.5 mm. An cuter depth 69 of the hinge-lid box is 22.5 mm.

Figures 6, 7:
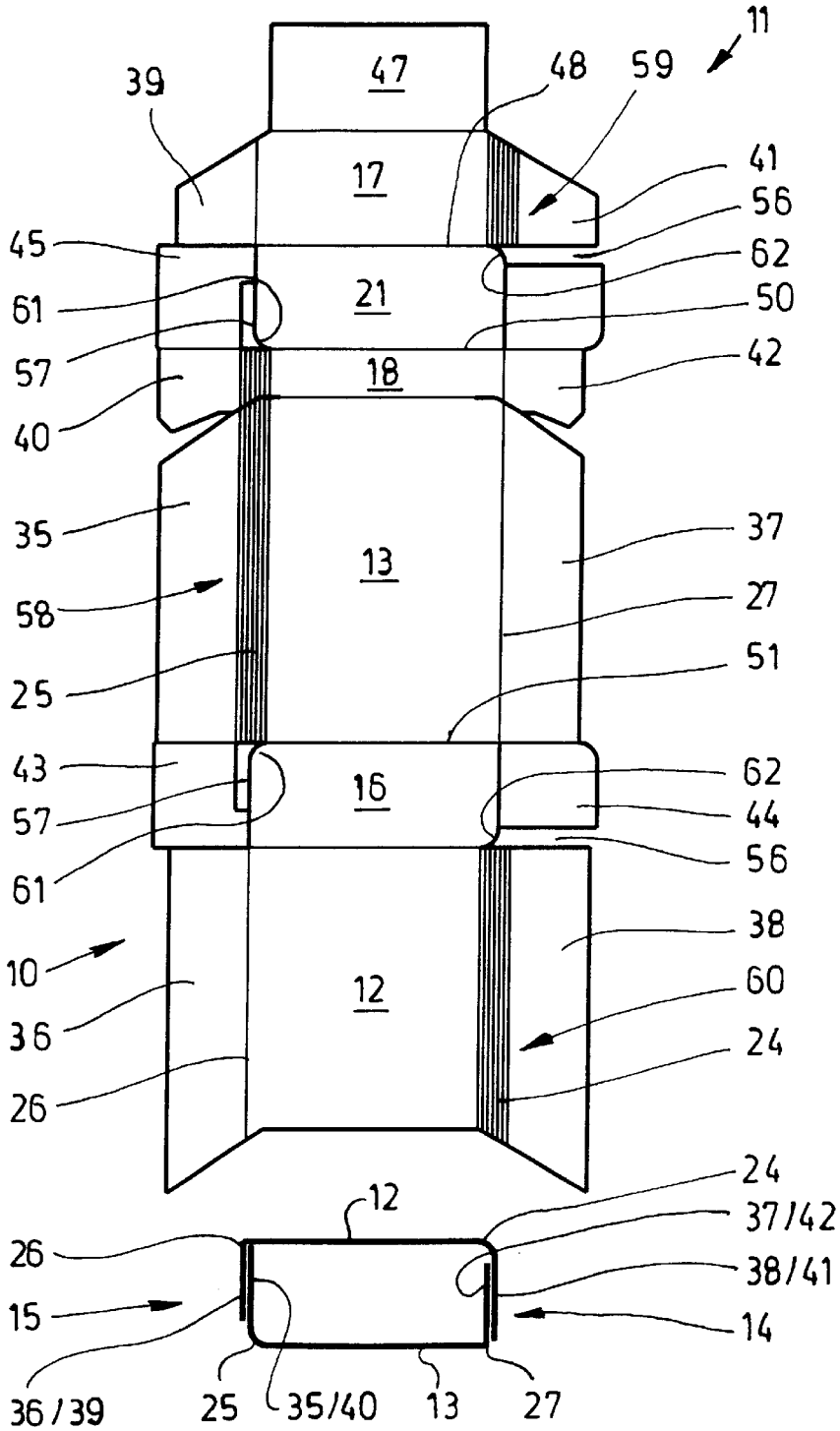
FIG. 6 shows a blank for a hinge-lid box according to FIG. 2.
FIG. 7 shows a vastly simplified cross section of a hinge-lid box from a blank according to FIG. 6.

The blank for a hinge-lid box according to FIG. 2 requires special design features. As shown in FIG. 6, in order to form the round edges 24 and 25 on diametrically opposite pack edges, a plurality of, namely three, impressed strips 58, 59, 60 are formed in the region of the blank. A first impressed strip 58 extends in the region of the box rear wall 13 and lid rear wall 18. The other two impressed strips are arranged on the opposite side of the blank, namely in the region of the box front wall 12, on the one hand, and of the lid front wall 17, on the other hand. Correspondingly, sections of a rectilinear folding line are provided opposite in each case in order to form the angular edges 26, 27.

The dimensions of the folding tabs are analogous to the exemplary embodiment according to FIG. 5. The cross section of the folded hinge-lid box according to FIG. 7 is to be seen in conjunction therewith. The side tabs 35 . . . 38 and lid side tabs 39 . . . 42 are designed such that, in the region of the angular edges 26, 27, the associated side tabs each extend into the angular edge, that is to say the inner side tab 35 and lid side tab 40 on one side, and the outer side tab 38 and lid side tab 41 extend to the associated angular edge 27. Accordingly, in this exemplary embodiment, the free width of the side tabs 35, 42 outside the region of the impressed strips 58, 59, 60, on the one hand, and the angular edges 26, 27, on the other hand, correspond to 17.5 mm (analogous to the width 68 in FIG. 5). The radius of the rounded sections 61, 62 and, correspondingly, of the round edges 24, 25 is 4 mm. Otherwise, the explanations given in relation to FIG. 5 apply correspondingly.

The Impressed strips 53 (FIG. 8) or 58, 59 and 60 (FIG. 10) each comprise, in these exemplary embodiments, two parallel folding edges 63, 64. These together form the bevelled edges 28, 29.

As far as the dimensions of the side tabs 37 and 38 and lid side tabs 41 and 42 are concerned, the explanations in relation to FIG. 5 apply analogously. However, the free width of the side tabs 37, 38 and of the lid side tabs 41 and 42 is greater than in the abovementioned exemplary embodiment, and in this case is 18.5 mm (analogous to width 68). This dimension is obtained from a smaller width of the impressed strip 53 and/or of the spacing between the folding edges 63, 64, and is 4.45 mm. Otherwise, the dimensions are as in FIG. 5. As can be seen from FIG. 9, the side tabs 37, 38; 41, 42 overlap one another merely outside the bevelled edges 28, 29.

Figures 10, 11:
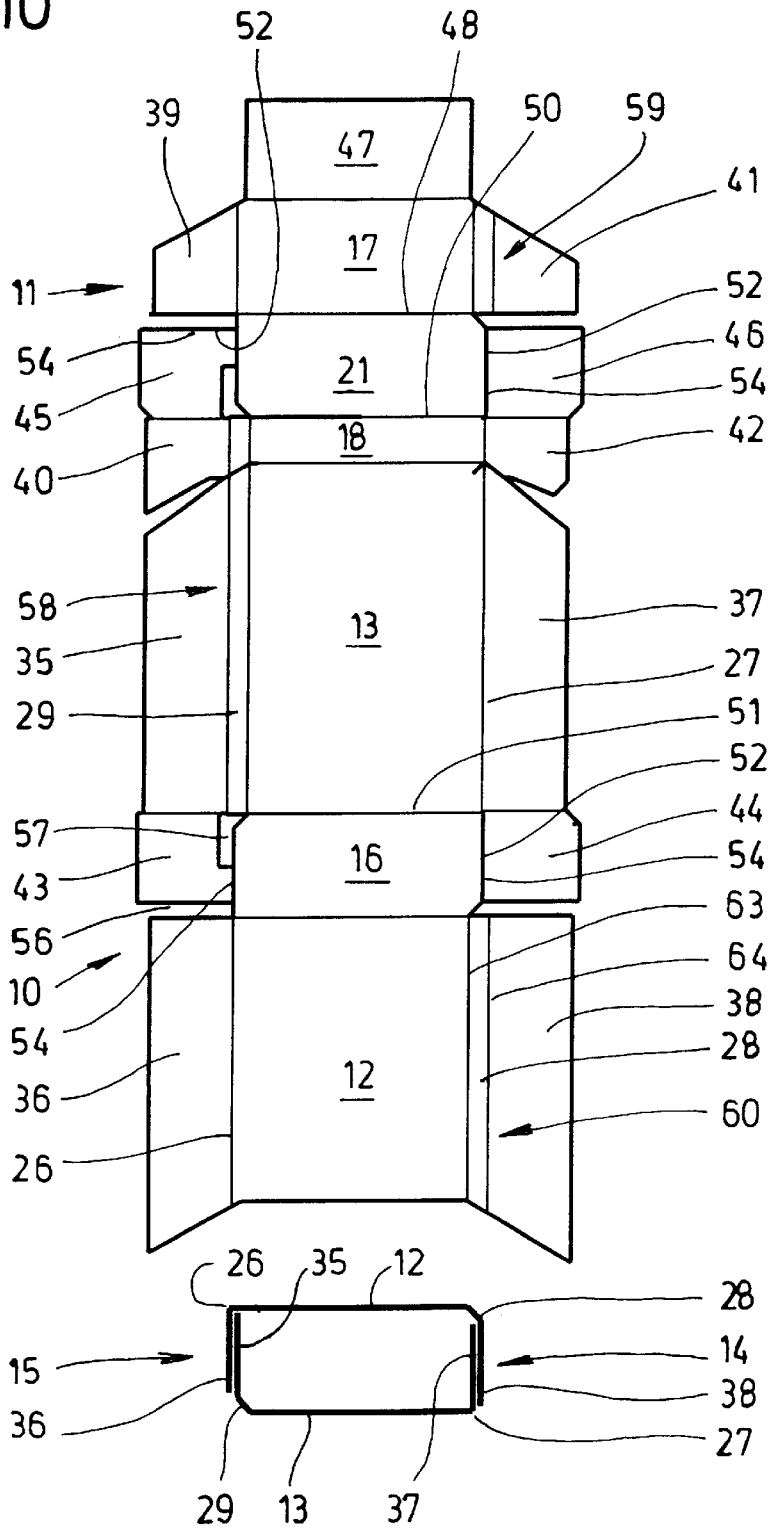
FIG. 10 shows a blank for a hinge-lid box according to FIG. 4.
FIG. 11 shows a vastly simplified cross section of a hinge-lid box from a blank according to FIG. 10.

Taking the predetermined design features into account, the blank according to FIG. 10 is designed in a manner analogous to FIG. 6. Here too, the impressed strips 58, 59, 60 each comprise two parallel folding edges 63, 64 with the spacings according to FIG. 8. The dimensioning of the side tabs 35 . . . 42 is coordinated therewith. Outside the impressed strips 58, 59, 60, and/or in the region of the angular edges 26, 27, it is 18.5 mm throughout.

A further special feature is the configuration of the collars 30 (for hinge-lid boxes with bevelled edges 28, 29) and 31 (for hinge-lid boxes with round edges 24, 25), said collars being formed here from separate blanks. The collars 30, 31, which have conventionally configured contours, each have a conventional collar edge 32 on one side, this being defined in the present case by punched cuts. In all the types of pack, this collar edge 32 extends in each case in the region of a front-side angular edge 26. In the exemplary embodiment of FIG. 12, a collar edge 33 designed as a bevelled edge, to be precise from two parallel folding lines 70, 71, is defined on the opposite side of the collar. In the present case, said folding lines are also formed by punched cuts or perforations. A collar front wall 72 is separated off from collar side tabs 73, 74 by the collar edges 32, on the one hand, and 33 or 34, on the other hand. The collar edge 33, which is designed as a bevelled edge, extends in each case in the region of a front-side bevelled edge 28 of the hinge-lid boxes according to FIG. 3 and FIG. 4.

In the case of the collar 31 according to FIG. 13, the collar edge 34 comprises a number of parallel impressed lines or scores corresponding, for example, to FIG. 6. These form a round edge of the collar 31 between the collar front wall 72 and collar side tab 73 in the region of a front-side round edge 24 of the packs according to FIG. 1 or FIG. 2.

LIST OF DESIGNATIONS

10 box part
11 lid
12 box front wall
13 box rear wall
14 box side wall
15 box side wall
16 base wall
17 lid front wall
18 lid rear wall
19 lid side wall
20 lid side wall
21 end wall
22 articulation line
23 closing line
24 round edge
25 round edge
26 angular edge
27 angular edge
28 bevelled edge
29 bevelled edge
30 collar
33 collar
32 collar edge
33 collar edge
34 collar edge
35 side tab
36 side tab
37 side tab
38 side tab
39 lid side tab
40 lid side tab
41 lid side tab
42 lid side tab
43 base corner tab
44 base corner tab
45 lid corner tab
46 lid corner tab
47 lid inner tab

48 front edge
49 front edge
50 rear edge
51 rear edge
52 punched line
53 impressed strip
54 supporting edge
55 round corner
56 cutout
57 clearance
58 impressed strip
59 impressed strip
60 impressed strip
61 rounded section
62 rounded section
63 folding edge
64 folding edge
65 oblique line
66 pack width
67 pack depth
68 width
69 outer depth
70 folding line
71 folding line
72 collar front wall
73 collar side tab
74 collar side tab

What is claimed is:

1. A hinge-lid box for cigarettes, comprising a box part (10), lid (11) and collar (30, 31), wherein a box rear wall (13) is pivotally connected to a lid rear wall (18) about a transversely directed articulation line (22), and wherein the hinge-lid box is of an overall cuboidal configuration with four upright box edges as a lateral boundary of a box front wall (12) and a lid front wall (17) and of the box rear wall (13) and lid rear wall (18), said hinge-lid box being characterized in that two of the four box edges are angular edges (26, 27), and the other two box edges are selected from the group consisting of round edges (24, 25) and bevelled edges (28, 29), the round edges (24, 25) and the bevelled edges (28, 29) being adapted, in terms of a quarter-circle and bevel dimensioning, respectively to dimensions of a cigarette, and one box side wall (14/19) is bounded by the round edges (24, 25) or by the bevelled edges (28, 29), and a respectively opposite box side wall (15/20) is bounded by the angular edges (26, 27).

2. The hinge-lid box according to claim 1, characterized in that the collar (30, 31) has in each case two differently configured collar edges (32; 33, 34), in each case one collar edge (32) being cross-sectionally right-angled in a region of an angular box edge (26), and the other collar edge (33) being bevelled in a region of a bevelled box edge (28), or rounded in a region of a round box edge (24).

3. A hinge-lid box for cigarettes, comprising a box part (10), lid (11) and collar (30, 31), wherein a box rear wall (13) is pivotally connected to a lid rear wall (18) about a transversely directed articulation line (22), and wherein the hinge-lid box is of an overall cuboidal configuration with four upright box edges as a lateral boundary of a box front wall (12) and a lid front wall (17) and of the box rear wall (13) and lid rear wall (18), said hinge-lid box being characterized in that two of the four box edges are angular edges (26, 27), and the other two box edges are selected from the group consisting of round edges (24, 25) and bevelled edges (28, 29), the round edges (24, 25) and the bevelled edges (28, 29) being adapted, in terms of a quarter-circle and bevel dimensioning, respectively to dimensions of a cigarette, and (a) the round edges (24, 25) or the bevelled edges (28, 29), and (b) the angular edges (26, 27), are arranged diagonally opposite one another.

4. The hinge-lid box according to claim 3, characterized in that the collar (30, 31) has in each case two differently configured collar edges (32; 33, 34), in each case one collar edge (32) being cross-sectionally right-angled in a region of an angular box edge (26), and the other collar edge (33) being bevelled in a region of a bevelled box edge (28), or rounded in a region of a round box edge (24).

5. An elongate blank for producing a hinge-lid box comprising a box part (10), lid (11) and collar (30, 31), wherein a box rear wall (13) is pivotally connected to a lid rear wall (18) about a transversely directed articulation line (22), and wherein the hinge-lid box is of an overall cuboidal configuration with four upright box edges as a lateral boundary of a box front wall (12) and a lid front wall (17) and of the box rear wall (13) and lid rear wall (18), said hinge-lid box being characterized in that two of the four box edges are angular edges (26, 27), and the other two box edges are selected from the group consisting of round edges (24, 25) and bevelled edges (28, 29). the round edges (24, 25) and the bevelled edges (28, 29) being adapted, in terms of a quarter-circle and bevel dimensioning, respectively, to dimensions of a cigarette wherein, formed within the elongate blank, are successive regions for the box front wall (12), a base wall (16), the box rear wall (13), the lid rear wall (18), a lid end wall (21) and for the lid front wall (17), and wherein box side tabs (35, 36, 37, 38) and lid side tabs (39, 40, 41, 42) are arranged in a region of the box front wall (12), of the box rear wall (13), of the lid rear wall (18) and of the lid front wall (17), on both sides in each case, in order to form box and lid side walls (14/19 and 15/20), characterized in that, in order to separate off the box and lid side tabs, oppositely assigned box walls are provided with impressed strips (53; 58, 59, 60), for forming the round edges (24, 25) or the bevel led edges (287 29), and with a rectilinear impressed line for forming the angular edges (26, 27), the impressed strips (53; 58, 59, 60) comprising a plurality of parallel scores for the round edges (24, 25) and two parallel folding edges (63, 64) for the bevelled edges (28, 29), and for the production of a hinge-lid box with round edges (24, 25) or bevelled edges (28, 29) arranged in a region of one box side wall (14), all impressed line (53) is formed continuously, to the base wall (16) and the lid end wall (21), on one side of the blank, and a single folding line is formed continuously on the other side of the blank.

6. The blank according to claim 5, characterized in that, in terms of their width, the box side tabs and the lid side tabs are designed such that, in a region of the round edges (24, 25) or the bevelled edges (28, 29), there is overlapping with associated ones of said box side tabs and lid side tabs, respectively, merely outside a region of the round edges (24, 25) or the bevelled edges (28, 29).

7. The blank according to claim 5, characterized in that base comer tabs (43, 44) of the box base wall (16) and lid corner tabs (45, 46) arranged respectively on box inner side tabs (35, 37) and lid side tabs (40, 42) are of a width, in a transverse direction of the blank, which corresponds to a box depth (67), such that the folded base comer tabs (43, 44) and lid corner tabs (45, 46) butt, by way of a supporting edge (54), against the box rear wall (13) and lid rear wall (18), respectively, in a region of a rear edge (50, 51).

8. An elongate blank for producing a hinge-lid box comprising a box part (10), lid (11) and collar (30, 31), wherein a box rear wall (13) is pivotally connected to a lid rear wall (18) about a transversely directed articulation line (22), and wherein the binge-lid box is of an overall cuboidal configuration with four upright box edges as a lateral boundary of a box front wall (12) and a lid front wall (17) and of the box rear wall (13) and lid rear wall (18), said hinge-lid box being characterized in that two of the four box edges are angular edges (26, 27), and the other two box edges are selected from the group consisting of round edges (24, 25) and bevelled edges (28, 29), the round edges (24, 25) and the bevelled edges (28, 29) being adapted, in terms of a quarter-circle and bevel dimensioning, respectively, to dimensions of a cigarette, wherein, formed within the elongate blank, are successive regions for the box front wall (12), a base wall (16), the box rear wall (13), the lid rear wall (18), a lid end wall (21) and for the lid front wall (17), and wherein box side tabs (35, 36, 37, 38) and lid side tabs (39, 40, 41, 42) are arranged in a region of the box front wall (12), of the box rear wall (13), of the lid rear wall (18) and of the lid front wall (17), on both sides in each case, in order to form box and lid side walls (14/19 and 15/20), characterized in that, in order to separate off the box and lid side tabs, oppositely assigned box walls are provided with impressed strips (53; 58, 59, 60), for forming the round edges (24, 25) or the bevelled edges (28, 29), and with a rectilinear impressed line for forming the angular edges (26, 27), the impressed strips (53; 58, 59, 60) comprising a plurality of parallel scores for the round edges (24, 25) and two parallel folding edges (63, 64) for the bevelled edges (28, 29), and for the production of binge-lid boxes with diagonally opposite round edges (24, 25) or bevelled edges (28, 29), sections of impressed strips (58, 59, 60) are arranged on mutually opposite sides of associated box and lid walls, a continuous impressed strip (58) being formed in a region of the box rear wall (13) and the lid rear wall (18), and further sections of impressed strips (59, 60) being formed in each case in a region of the box front wall (12) and the lid front wall (17).

9. An elongate blank for producing a hinge-lid box comprising a box part (10), lid (11) and collar (30, 31), wherein a box rear wall (13) is pivotally connected to a lid rear wall (18) about a transversely directed articulation line (22), and wherein the hinge-lid box is of an overall cuboidal configuration with four upright box edges as a lateral boundary of a box front wall (12) and a lid front wall (17) and of the box rear wall (13) and lid rear wall (18), said hinge-lid box being characterized in that two of the four box edges are angular edges (26, 27), and the other two box edges are selected from the group consisting of round edges (24, 25) and bevelled edges (28, 29), the round edges (24, 25) and the bevelled edges (28, 29) being adapted, in terms of a quarter-circle and bevel dimensioning, respectively, to dimensions of a cigarette, wherein, formed within the elongate blank, are successive regions for the box front wall (12), a base, wall (16), the box rear wall (13), the lid rear wall (18), a lid end wall (21) and for the lid front wall (17), and wherein box side tabs (35, 36, 37, 38) and lid side tabs (39, 40, 41, 42) are arranged in a region of the box front wall (12), of the box rear wall (13), of the lid rear wall (18) and of the lid front wall (17), on both sides in each case, in order to form box and lid side walls (14/19 and 15/20), characterized in that, in order to separate off the box and lid side tabs, oppositely assigned box walls are provided with impressed strips (53; 58, 59, 60), for forming the round edges (24, 25) or the bevelled edges (287 29), and with a rectilinear impressed line for forming the angular edges (26, 27), the impressed strips (53; 58, 59, 60) comprising a plurality of parallel scores for the round edges (24, 25) and two parallel folding edges (63, 64) for the bevelled edges (28, 29), and base corner tabs (43, 44) of the box base wall (16) and lid corner tabs (45, 46) arranged in a region of the round edges (24, 25) or bevelled edges (28, 29) have, in a region of an adjacent round edge (24, 25) or bevelled edge (28, 29), a clearance (57) formed by punching, so as to expose the base wall (16) or the lid end wall (21) in a region of each round edge (24, 25) or each bevelled edge (28, 29).

10. An elongate blank for producing a hinge-lid box comprising a box part (10), lid (11) and collar (30, 31), wherein a box rear wall (13) is pivotally connected to a lid rear wall (18) about a transversely directed articulation line (22), and wherein the hinge-lid box is of an overall cuboidal configuration with four upright box edges as a lateral boundary of a box front wall (12) and a lid front wall (17) and of the box rear wall (13) and lid rear wall (18), said hinge-lid box being characterized in that two of the four box edges are angular edges (26, 27), and the other two box edges are selected from the group consisting of round edges (24, 25) and bevelled edges (28, 29), the round edges (24, 25) and the bevelled edges (28, 29) being adapted, in terms of a quarter-circle and bevel dimensioning, respectively, to dimensions of a cigarette, wherein, formed within the elongate blank, are successive regions for the box front wall (12), a base wall (16), the box rear wall (13), the lid rear wall (18), a lid end wall (21) and for the lid front wall (17), and wherein box side tabs (35, 36, 37, 38) and lid side tabs (39, 40, 41, 42) are arranged in a region of the box front wall (12), of the box rear wall (13), of the lid rear wall (18) and of the lid front wall (17), on both sides in each case, in order to form box and lid side walls (14/19 and 15/20), characterized in that, in order to separate off the box and lid side tabs, oppositely assigned box walls are provided with impressed strips (53; 58, 59, 60), for forming the round edges (24, 25) or the bevelled edges (28, 29), and with a rectilinear impressed line for forming the angular edges (26, 27), the impressed strips (53; 58, 59, 60) comprising a plurality of parallel scores for the round edges (24, 25) and two parallel folding edges (63, 64) for the bevelled edges (28, 29), and between (a) base corner tabs (43, 44) of the base wall (16) or lid corner tabs (45, 46) of the lid (11), and (b) box outer side tabs (36, 38) or lid side tabs (39, 41), a cutout (56) is formed by punching such that the base and lid corner tabs have a reduced dimension in the longitudinal direction of the elongate blank.

* * * * *